US007858867B2

(12) United States Patent
Sherwani et al.

(10) Patent No.: US 7,858,867 B2
(45) Date of Patent: Dec. 28, 2010

(54) METADATA-BASED SONG CREATION AND EDITING

(75) Inventors: Adil Ahmed Sherwani, Seattle, WA (US); Chad C. Gibson, Seattle, WA (US); Sumit Basu, Seattle, WA (US)

(73) Assignee: Microsoft Corporation, Redmond, WA (US)

( * ) Notice: Subject to any disclaimer, the term of this patent is extended or adjusted under 35 U.S.C. 154(b) by 0 days.

(21) Appl. No.: 12/844,363

(22) Filed: Jul. 27, 2010

(65) Prior Publication Data

US 2010/0288106 A1 Nov. 18, 2010

Related U.S. Application Data

(62) Division of application No. 11/415,327, filed on May 1, 2006, now Pat. No. 7,790,974.

(51) Int. Cl.
*A63H 5/00* (2006.01)

(52) U.S. Cl. ..... 84/609

(58) Field of Classification Search ..... 84/609
See application file for complete search history.

(56) References Cited

U.S. PATENT DOCUMENTS

| | | | |
|---|---|---|---|
| 5,054,360 | A | 10/1991 | Lisle et al. |
| 6,281,424 | B1 | 8/2001 | Koike et al. |
| 6,462,264 | B1 | 10/2002 | Elam |
| 7,227,073 | B2 | 6/2007 | Kim |
| 2003/0014262 | A1 | 1/2003 | Kim |
| 2004/0089134 | A1 | 5/2004 | Georges et al. |
| 2005/0187976 | A1 | 8/2005 | Goodman et al. |
| 2006/0028951 | A1 | 2/2006 | Tozun et al. |
| 2006/0054007 | A1 | 3/2006 | Lu et al. |

FOREIGN PATENT DOCUMENTS

WO 03/094148 A1 11/2003

OTHER PUBLICATIONS

Feng, Yazhong et al., Music Information Retrieval by Detecting Mood via Computational Media Aesthetics, pp. 235-241, WI, Oct. 13-17, 2003.

GarageBand at a Glance, Apple Computer, Inc. 2004, 9 pages.

Kitagawa, Takashi et al., An Implementation method of automatic metadata extraction method for music data and its application to semantic associative search, Abstract printed from http://www3.interscience.wiley.com/cgi-bin/abstract/108061992/ABSTRACT, 2004, Wiley Periodicals, Inc., 2 pages, USA.

(Continued)

*Primary Examiner*—Elvin G Enad
*Assistant Examiner*—Andrew R Millikin
(74) *Attorney, Agent, or Firm*—Senniger Powers LLP

(57) ABSTRACT

Relating higher-level descriptive musical metadata to lower-level musical elements to enable creation of a song map, song model, backing track, or the like. The musical elements are queried based on input metadata to create a set of musical elements of varying types such as notes, chords, song structures, and the like. The set of musical elements is provided to a user for selection of particular musical elements The selected musical elements represent the song model.

20 Claims, 7 Drawing Sheets

OTHER PUBLICATIONS

Tzanetakis, George et al., Musical Genre Classification of Audio Signals, IEEE Transactions on Speech and Audio Processing, vol. 10, No. 5 (2002) pp. 293-302.
Whitman, Brian et al., Inferring Descriptions and Similarity for Music from Community Metadata, Proceedings of the 2002 International Computer Music Conference, 2002, University of Michigan, 8 pages, USA.
Willmore, Matt, Expanding Your Garage Band Loop Library (2004) http://web.archive.org/web/20040404032647/http://maczealots.com/tutorials/loops/, 7 pages.
Unknown, "GarageBand 3," printed from http://www.apple.com/ilife/garageband/, 2006, 3 pages, Apple Computer, Inc., USA.
Unknown, What is a Virtual Bassist?, printed from http://www.steinberg.net/219_1.html printed on Apr. 18, 2006, 4 pages, Steinberg Media Technologies GmbH, Germany.
Unknown, Groove Agent 2—Your Virtual Drummer, http://www.steinberg.net/158_1.html printed on Apr. 18, 2006, 2 pages, Steinberg Media Technologies GmbH, Germany.
Unknown, How Does Groove Agent 2 Work?, http://www.steinberg.net/165_1.html printed on Apr. 18, 2006, 2 pages, Steinberg Media Technologies GmbH, Germany.
Unknown, What is Virtual Guitarist?, http://www.steinberg.net/171_1.html printed on Apr. 18, 2006, 2 pages, Steinberg Media Technologies GmbH, Germany.
Unknown, Band-in-a-Box Packages, http://www.pgmusic.com/bbwin_newfeatures.htm printed on Apr. 18, 2006, 7 pages, PG Music, Inc., USA.
Unknown, GarageBand3, http://www.apple.com/ilife/garageband/ printed on Apr. 18, 2006, 3 pages, Apple Computer, Inc., USA.
Unknown, Virtual Bassist—Your Virtual Bass Guitar Player, http://www.steinberg.net/160_1.html printed on Apr. 18, 2006, 2 pages, Steinberg Media Technologies GmbH, Germany.

METADATA-BASED SONG CREATION AND EDITING

CROSS REFERENCE TO RELATED APPLICATION

This application is a divisional of U.S. Non Provisional application Ser. No. 11/415,327, filed May 1, 2006, the entire contents of which are incorporated herein by reference.

BACKGROUND

Traditional methods for creating a song or musical idea include composing the exact sequences of notes for each instrument involved and then playing all the instruments simultaneously. Contemporary advances in music software for computers allow a user to realize musical ideas without playing any instruments. In such applications, software virtualizes the instruments by generating the sounds required for the song or musical piece and plays the generated sounds through the speakers of the computer.

Existing software applications employ a fixed mapping between the high-level parameters and the low-level musical details of the instruments. Such a mapping enables the user to specify a high-level parameter (e.g., a musical genre) to control the output of the instruments. Even though such applications remove the requirement for the user to compose the musical details for each instrument in the composition, the fixed mapping is static, limiting, and non-extensible. For example, with the existing software applications, the user still needs to specify the instruments required, the chord progressions to be used, the structure of song sections, and specific musical sequences in the virtual instruments that sound pleasant when played together with the other instruments. Additionally, the user has to manually replicate the high-level information across all virtual instruments, as there is no unified method to specify the relevant information to all virtual instruments simultaneously. As such, such existing software applications are too complicated for spontaneous experimentation in musical ideas.

SUMMARY

Embodiments of the invention dynamically map high-level musical concepts to low-level musical elements. In an embodiment, the invention defines a plurality of musical elements and musical element values associated therewith. Metadata describes each of the plurality of musical elements and associated musical element values. An embodiment of the invention queries the defined plurality of musical elements and associated musical element values based on selected metadata to dynamically produce a set of musical elements and associated musical element values associated with the selected metadata. The produced set of musical elements and associated musical element values is provided to a user.

Aspects of the invention dynamically map low-level musical elements to high-level musical concepts. In particular, aspects of the invention receive audio data (e.g., as analog data or as musical instrument digital interface data) and identify patterns within the received data to determine musical elements corresponding to the identified patterns. Based on the mapping between the low-level musical elements and the high-level musical concepts represented as metadata, an embodiment of the invention identifies the metadata corresponding to the determined musical elements. The identified metadata may be used to dynamically adjust a song model associated with the received data.

This summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Other features will be in part apparent and in part pointed out hereinafter.

BRIEF DESCRIPTION OF THE DRAWINGS

Corresponding reference characters indicate corresponding parts throughout the drawings.

DETAILED DESCRIPTION

Figure 1:
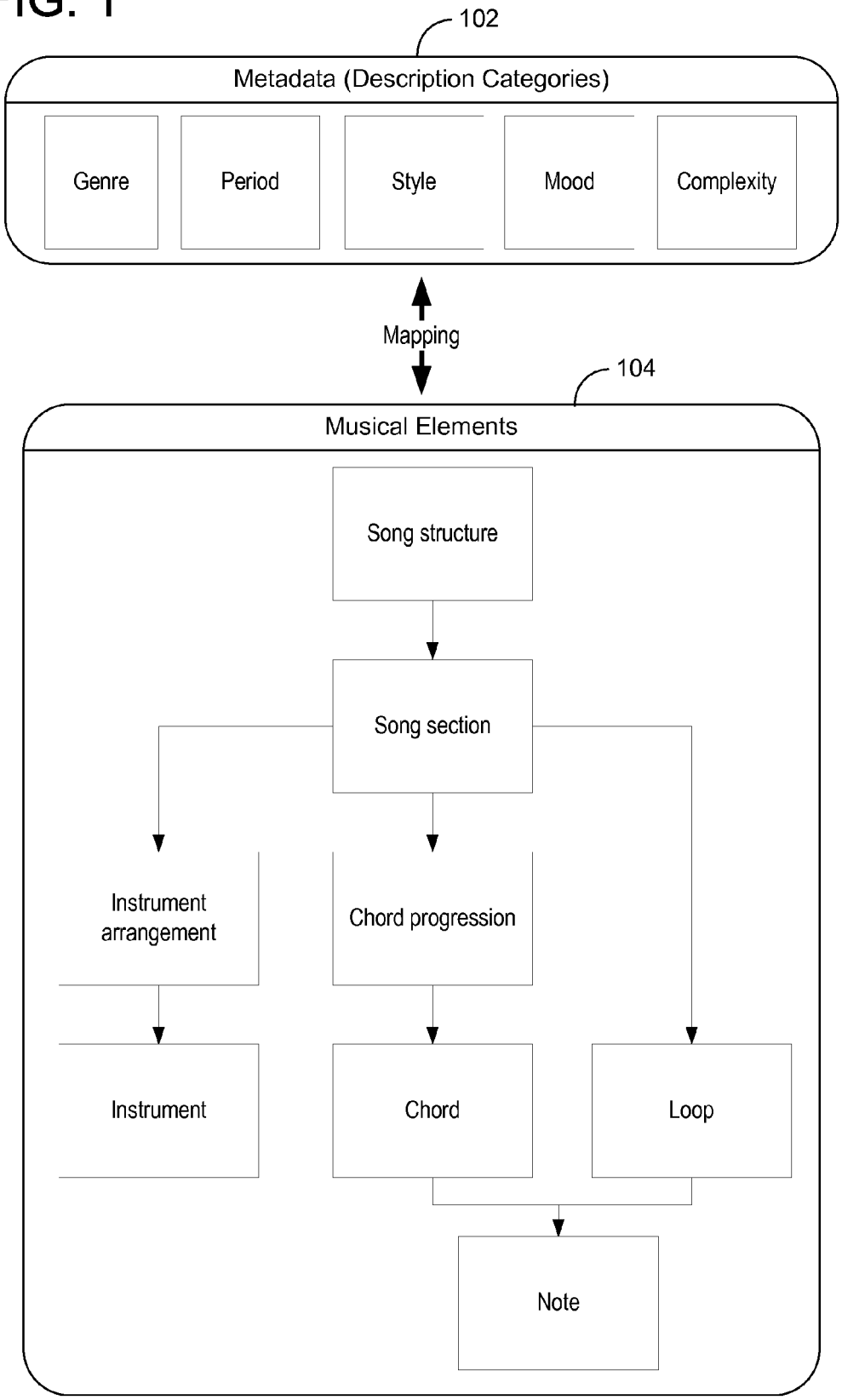
FIG. 1 is an exemplary block diagram illustrating the relationship between metadata and musical elements.

In an embodiment, the invention identifies correlations between high-level musical concepts and low-level musical elements such as illustrated in FIG. 1 to create a song model. The song model represents a backing track, song map, background music, or any other representation of a musical composition or structure. In particular, aspects of the invention include a database dynamically mapping metadata describing music to particular instruments, chords, notes, song structures, and the like. The environment in aspects of the invention provides a spontaneous and engaging music creation experience for both musicians and non-musicians in part by encouraging experimentation.

In FIG. 1, an exemplary block diagram illustrates the relationship between metadata 102 (e.g., description categories and description values) and musical elements 104. As music contains several layers of concepts, information at a conceptually higher layer may non-deterministically imply information at lower layers and vice versa. Exemplary description categories include genre, period, style, mood, and complexity. These categories represent emotional characteristics of music rather than mathematical or technical aspects of the music. A user may configure the description categories by, for example, creating custom categories and relevant description values. Exemplary description categories and corresponding description values are shown in Table 1.

TABLE 1

Exemplary Description Categories and Description Values.

| Description Category | Exemplary Definition | Examples of Description Values |
|---|---|---|
| Genre | Category of music | Rock, Hip-hop, Jazz |
| Period | Chronological period to which particular musical concepts belong | 50 s, 70 s, 90 s |
| Style | The characteristics of a particular composer or performer that give their work a unique and distinct feel | Bach's Inventions, Dave Brubeck playing the piano |
| Mood | Emotional characteristics of music | Dark, Cheerful, Intense, Melancholy, Manic |
| Complexity | A rough measure of how "busy" a piece of music is with respect to the number of instruments and notes playing, durations of notes, and/or level of dissonance and arrhythmic characteristics in the sound | Very Simple, Simple, Medium, Complex, Very Complex |

The description categories (and values associated therewith) are mapped to lower-level musical elements 104 such as song structure, song section, instrument arrangement, instrument, chord progression, chord, loop, note, and the like. Within the musical elements 104, several layers may also be defined such as shown in FIG. 1. For example, lower layers of musical elements 104 involve concepts such as musical notes with each note having properties such as pitch, duration, velocity, and the like. Exemplary concepts at a higher layer include chords (e.g., combinations of notes) and loops (e.g., sequences of notes arranged in a particular way). Exemplary concepts at a yet higher layer include chord progressions (e.g., harmonic movement in chords) and song structures (e.g., patterns of arrangement of chord progressions and loops across time). Exemplary musical elements 104 and corresponding musical element values are shown in Table 2.

The spread of mappings from higher to lower layers varies from genre to genre. Similarly, songs using specific kinds of musical elements 104 (e.g., instruments, chord progressions, loops, song structures, and the like) are likely to belong to specific description categories (e.g., genre, mood, complexity, and the like) at the higher level. This is the relationship people recognize when listening to a song and identifying the genre to which it belongs. Further, dependencies exist between the values of different musical elements 104 in one embodiment. For example, a particular chord may be associated with a particular loop or instrument. In another embodiment, no such dependencies exist in that the musical elements 104 are orthogonal or independent of each other. Aspects of the invention describe a technique to leverage these mappings to automate the processes of song creation and editing

TABLE 2

Exemplary Musical Elements and Musical Element Values.

| Musical Element | Exemplary Definition | Examples of Musical Element Values |
|---|---|---|
| Note | A specific pitch played at a specific time for a specific duration, with some additional musical properties such as velocity, bend, mod, envelope, etc | C, Db, F# |
| Instrument | Voice/sound generator | Piano, Guitar, Trumpet |
| Chord | Multiple notes played simultaneously | C = C + E + G<br>Dm = D + F + A |
| Loop | Sequence of notes, generally all played by the same instrument | Funk Loop 1 = C D C E D |
| Instrument arrangement | List of instruments played together | Drums, Bass Guitar, Electric Guitar |
| Chord progression | Sequence of chords | C Am F G |
| Song section | Temporal division of a song containing a single chord progression, instrument arrangement and sequence of loops per instrument | Intro, Verse, Chorus, Bridge |
| Song structure | Sequence of song sections | A B A B C B B |

Songs with similar attributes of genre, complexity, mood, and other description categories often use similar expressions at lower musical layers. For example, many blues songs use similar chord progressions, song structures, chords, and riffs. thereby making it easier for musicians and non-musicians to express musical ideas at a high level of abstraction.

Figure 2:
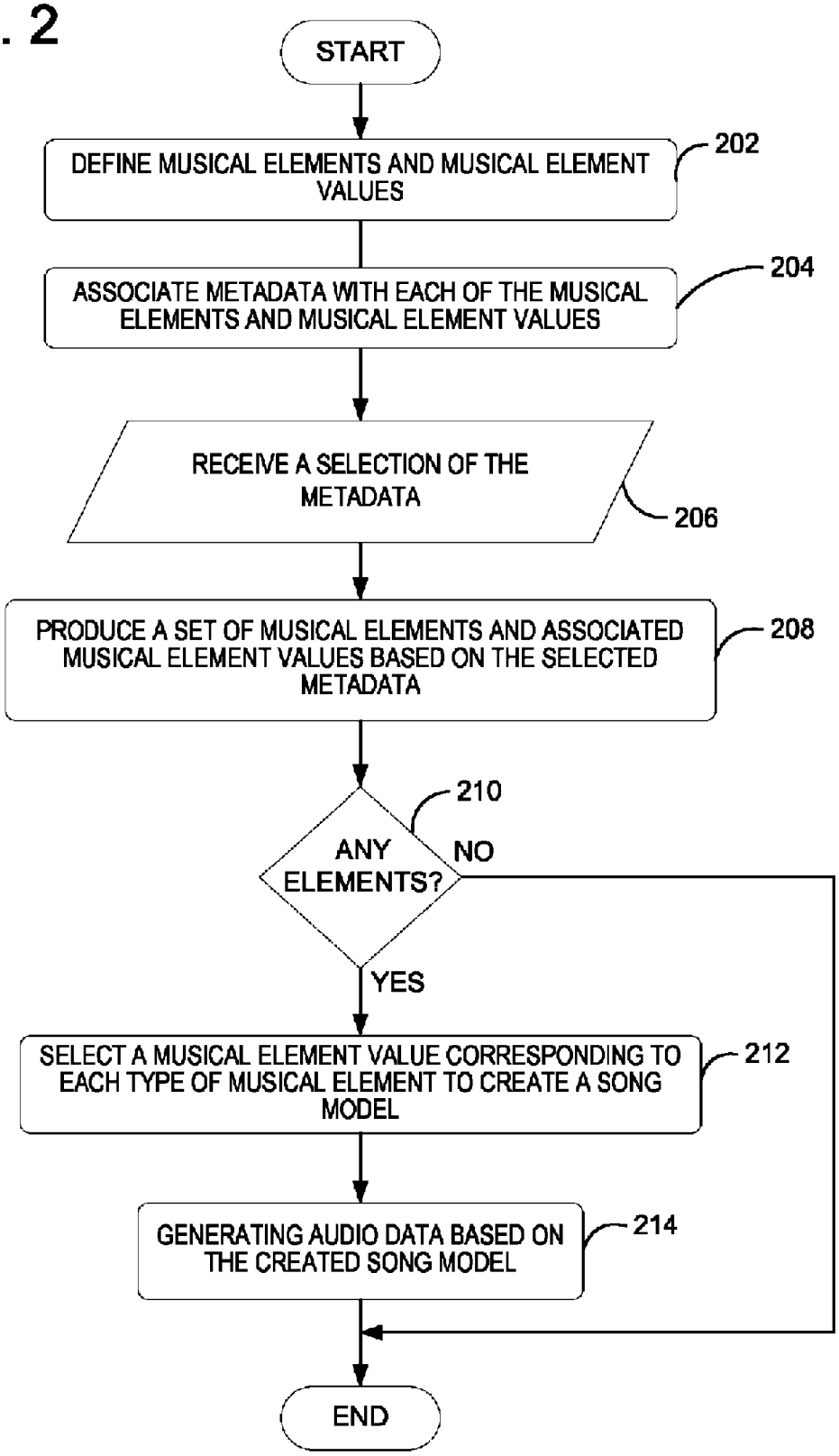
FIG. 2 is an exemplary flow chart illustrating creation of a song model based on an input metadata.

Referring next to FIG. 2, an exemplary flow chart illustrates creation of a song model based on an input metadata (e.g., metadata 102 in FIG. 1). Low-level musical elements and associated values are defined at 202. Metadata is associated with each of the defined musical elements and associated values at 204. For example, commonly used instruments, song structures, chord progressions, and performance styles for a particular genre of music may be identified. The genre name may be associated with each of these low-level musical elements. For example, the metadata may comprise one or more description categories and associated description values in the form of "description category=description value". Examples include "genre=rock" and "mood=cheerful". These name-value pairs are associated with each of the musical elements and associated musical element values. Musical elements and associated musical element values may have a plurality of description categories and associated description values. For example, an electric guitar may be associated with both "genre=rock" and "genre=country". Further, users may tag their music with customized keywords such as emotional cues.

For metadata received from the user at 206, aspects of the invention produce a set of musical elements and associated musical element values having the received metadata associated therewith at 208. The metadata may be a particular keyword (e.g., a particular genre such as "rock"), or a plurality of descriptive metadata terms or phrases corresponding to the genre, subgenre, style information, user-specific keywords, or the like. In another embodiment, the metadata is determined without requiring direct input from the user. For example, aspects of the invention may examine the user's music library to determine what types of music the user likes and infer the metadata based on this information.

In one embodiment, aspects of the invention produce the set of musical elements by querying the correlations between the metadata and the musical elements. If no musical elements were produced at 210, the process ends. If the set of musical elements is not empty at 210, one or more musical elements corresponding to each type of musical element are selected to create the song model at 212. For example, musical elements may be selected per song section and/or per instrument. Alternatively or in addition, aspects of the invention select or order musical elements based on a weight with each musical element value or the metadata associated therewith. For example, the weight assigned to "genre=rock" for an electric guitar may be more significant relative to the weight assigned to "genre=country" for the electric guitar. In this manner, aspects of the invention provide a song model without a need for the user to select all the musical elements associated with the song model (e.g., instruments, chords, etc.).

The song model with the selected musical element values may be displayed to the user, or used to generate audio data at 214 representing the backing track, song map, or the like. Alternatively or in addition, the song model is sent to virtual instruments via standard musical instrument digital interface (MIDI) streams.

In one embodiment, one or more computer-readable media have computer-executable instructions for performing the method illustrated in FIG. 2.

Figure 3:
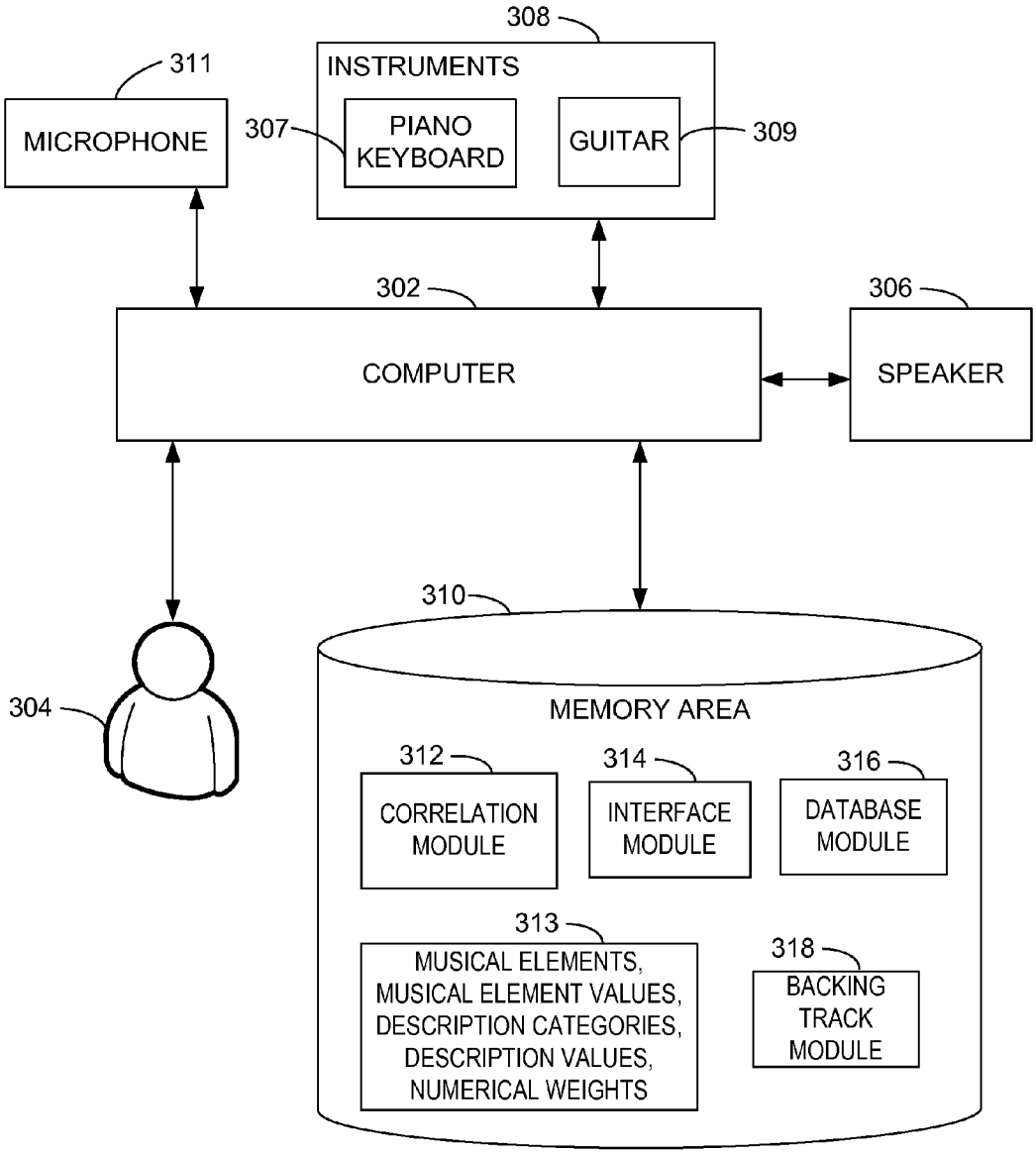
FIG. 3 is an exemplary block diagram illustrating an exemplary operating environment for aspects of the invention.

Referring next to FIG. 3, an exemplary block diagram illustrates an exemplary operating environment for aspects of the invention. FIG. 3 shows one example of a general purpose computing device in the form of a computer 302 accessible by a user 304. Examples of well known computing systems, environments, and/or configurations that may be suitable for use with aspects of the invention include, but are not limited to, personal computers, server computers, hand-held or laptop devices, multiprocessor systems, microprocessor-based systems, set top boxes, programmable consumer electronics, mobile telephones, network PCs, minicomputers, mainframe computers, distributed computing environments that include any of the above systems or devices, and the like. The user 304 may enter commands and information into computer 302 through input devices or user interface selection devices such as a keyboard and a pointing device (e.g., a mouse, trackball, pen, or touch pad). In one embodiment of the invention, a computing device such as the computer 302 is suitable for use in various embodiments of the invention. In one embodiment, computer 302 has one or more processors or processing units, one or more speakers 306, access to one or more external instruments 308 (e.g., a keyboard 307 and a guitar 309) via a MIDI interface or analog audio interface, access to a microphone 311, and access to a memory area 310 or other computer-readable media. The computer 302 may replicate the sounds of instruments such as instruments 308 and render those sounds through the speakers 306 to create virtual instruments. Alternatively or in addition, the computer 302 may communicate with the instruments 308 to send the musical data to the instruments 308 for rendering.

Computer readable media, which include both volatile and nonvolatile media, removable and non-removable media, may be any available medium that may be accessed by computer 302. By way of example and not limitation, computer readable media comprise computer storage media and communication media. Computer storage media include volatile and nonvolatile, removable and non-removable media implemented in any method or technology for storage of information such as computer readable instructions, data structures, program modules or other data. Communication media typically embody computer readable instructions, data structures, program modules, or other data in a modulated data signal such as a carrier wave or other transport mechanism and include any information delivery media. Those skilled in the art are familiar with the modulated data signal, which has one or more of its characteristics set or changed in such a manner as to encode information in the signal. Wired media, such as a wired network or direct-wired connection, and wireless media, such as acoustic, RF, infrared, and other wireless media, are examples of communication media. Combinations of any of the above are also included within the scope of computer readable media.

The computer 302 may operate in a networked environment using logical connections to one or more remote computers, such as a remote computer. Generally, the data processors of computer 302 are programmed by means of instructions stored at different times in the various computer-readable storage media of the computer 302. Although described in connection with an exemplary computing system environment, including computer 302, embodiments of the invention are operational with numerous other general purpose or special purpose computing system environments or configurations. The computing system environment is not intended to suggest any limitation as to the scope of use or functionality of any aspect of the invention. Moreover, the computing system environment should not be interpreted as having any dependency or requirement relating to any one or combination of components illustrated in the exemplary operating environment.

In operation, computer 302 executes computer-executable instructions such as those illustrated in the figures to implement aspects of the invention.

The memory area 310 stores correlations between the plurality of musical elements and the metadata (e.g., musical elements, musical element values, description categories, and description values 313). In addition, the memory area 310 stores computer-executable components including a correlation module 312, an interface module 314, a database module 316, and a backing track module 318. The correlation module 312 defines the plurality of musical elements and associated musical element values and the description categories and associated description values. The interface module 314 receives, from the user 304, the selection of at least one of the description categories and at least one of the description values associated with the selected description category. The database module 316 queries the plurality of musical elements and associated musical element values defined by the correlation module 312 based on the description category and the description value selected by the user 304 via the interface module 314 to produce a set of musical elements and associated musical element values. The backing track module 318 selects, from the set of musical elements and associated musical element values from the database module 316, at least one of the musical element values corresponding to each type of musical element to create the song model.

In one embodiment, the musical elements, musical element values, description categories, and description values 313 are stored in a database as a two-dimensional table. Each row represents a particular instance of a lower-level element (e.g., a particular loop, chord progression, song structure, or instrument arrangement). Each column represents a particular instance of a higher-level element (e.g., a particular genre, mood, or style). Each cell has a weight of 0.0 to 1.0 that indicates the strength of the correspondence between the low-level item and the higher-level item. For example, a particular loop may be tagged with 0.7 for rock, 0.5 for pop and 0.2 for classical. Similarly, the particular loop may be tagged with 0.35 for "happy", 0.9 for "manic", and 0.2 for "sad". The weights may be generated algorithmically, by humans, or both. A blank cell indicates that no weight exists for the particular mapping between the higher-level element and the low-level element.

In another embodiment, the database includes a one-dimensional table to enable the database to be extended with custom higher-level elements. Each row in the table corresponds to a particular instance of a lower-level element. Each row is further marked with additional tags to map each lower-level element to higher-level items. For example, the tags include an identification of the higher-level items along with a weight. In this manner, new higher-level elements may be created easily and arbitrarily without adding columns to the database. For example, a user creates a genre with a unique name and tags some of the lower-level elements with the unique name and weight corresponding to that genre.

In another embodiment, the mappings between the lower-level and higher-level elements are generated collectively by a community of users. The mappings may be accomplished with or without weights. If no weights are supplied, the weights may be algorithmically determined based on the number of users who have tagged a particular lower-level element with a particular higher-level element.

Figure 4:
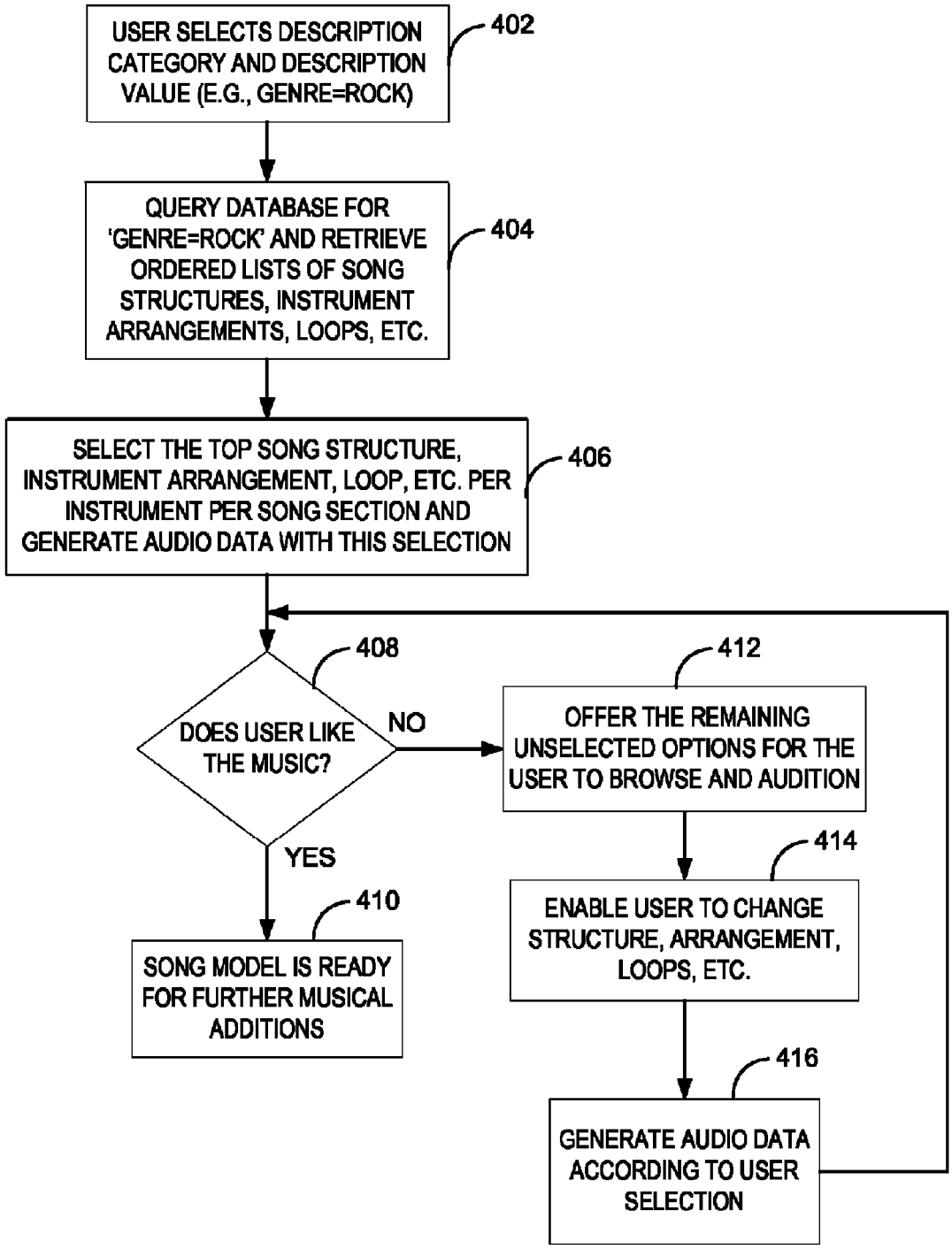
FIG. 4 is an exemplary flow chart illustrating an embodiment of the invention in which a user selects a genre and manipulates the resulting song model.

Referring next to FIG. 4, an exemplary flow chart illustrates an embodiment of the invention in which a user selects a genre and manipulates the resulting song model. At 402, the user selects a description category and description value such as "genre=rock". Aspects of the invention query the database at 404 for the metadata "genre=rock" to retrieve and order lists of musical elements of various types including, for example, song structures, instrument arrangements, loops, and the like. At 406, the first musical element in each list is selected (e.g., per instrument per song section). For example, the top song structure, the top instrument arrangement, and the top loop are selected. Audio data is generated based on these selections and rendered to the user.

If the user likes the rendered music at 408, the song model is ready for further musical additions at 410. If the user is not satisfied with the rendered audio at 408, some or all of the remaining unselected musical elements from each of the lists are presented to the user for browsing and audition at 412. These unselected musical elements represent the statistically possible options that the user may audition and select if the user dislikes the sound generated based on the automatically selected musical elements. A user interface associated with aspects of the invention enables the user to change any of the musical elements at 414, while audio data reflective of the changed musical elements is rendered to the user at 416. In this manner, the user auditions alternate options from these lists and rapidly selects options that sound better to quickly and easily arrive at a pleasant-sounding song model.

In one example, querying the database at 404 includes retrieving all entries in a database that have been tagged with a valid weight to, for example, "genre=Jazz". The highest-scoring loops, chord progressions, song structures and instrument arrangements for Jazz are ordered into lists. Selecting the first musical element at 406 includes automatically selecting the highest-scoring instrument arrangement and song structure. For each song section, the highest scoring chord progression is selected. For each instrument in each song section, the highest-scoring loop is selected. In one embodiment, aspects of the invention attempt to minimize repetition of any loop or chord progression within a particular song. Ties may be resolved by random selection. A set of the next-highest, unselected musical elements is provided to the user for auditioning and selection. If the user selects a particular instrument or song section to change, aspects of the invention apply the algorithm only within the selected scope.

Figure 5:
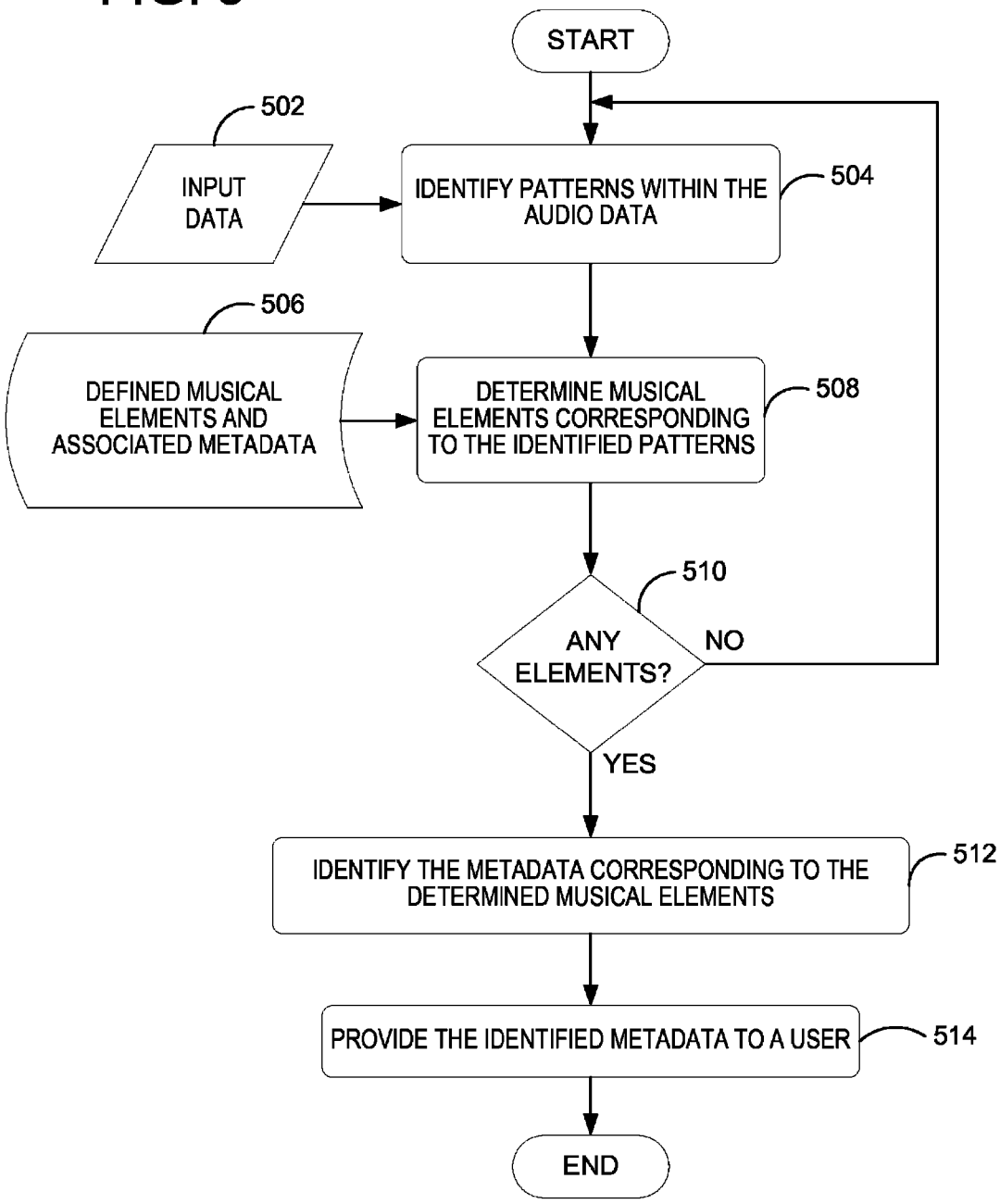
FIG. 5 is an exemplary flow chart illustrating identification of metadata associated with input audio or musical instrument digital interface (MIDI) data.

Referring next to FIG. 5, an exemplary flow chart illustrates identification of description categories and values associated with input analog audio data or MIDI audio data. The flow chart in FIG. 5 illustrates the analysis of a human-generated musical performance (e.g., based on analog audio input or MIDI input) to determine higher-level attributes of the performance such as musical style, tempo, intensity, complexity, and chord progressions from lower-level data associated with the musical performance. In one embodiment, the analysis uses the metadata and mappings as described and illustrated herein. The human-generated musical performance includes, for example, the user playing a musical instrument along with the backing tracks generated per the methods described herein. Based on the input musical data at 502 from the user (e.g., analog audio data or MIDI data), embodiments of the invention identify patterns within the input musical data at 504. For example, the user may be playing music on a computer keyboard, selecting chords, playing music on an external instrument, or using a pitch tracker. A pitch tracker is known in the art. The input musical data may include, but is not limited to, a note, a chord, a drum kick, or a letter representing a note. Pattern identification may occur, for example, via one or more of the following ways as generally known in the art: fuzzy matching, intelligent matching, and neural network matching. In addition, pattern identification may occur, for example, based on one or more of the following: rhythm, notes, intervals, tempo, note sequence, and interval sequence.

Based on the defined correlations between the musical elements and the metadata (e.g., see FIG. 1) at 506, musical elements corresponding to the identified patterns are determined at 508. The musical elements represent, for example, specific notes being played. At 510, if no elements have been determined, the process continues at 504 to analyze the input musical data for patterns. At 510, if one or more musical elements have been determined, embodiments of the invention identify the metadata corresponding to the determined musical elements at 512. Identifying the metadata may include identifying a description category and associated description value (e.g., "genre=rock") and determining loops and chord progressions that the user is playing. The identified metadata is provided to the user at 514. In one embodiment, one or more computer-readable media have computer-executable instructions for performing the method illustrated in FIG. 5.

In one embodiment, the identified metadata is provided to the user as rendered audio. For example, the identified metadata is used to query the plurality of musical elements to produce a set of musical elements from which at least one of the musical elements corresponding to each type of musical element is selected. For example, aspects of the invention may select one of the song structures, one of the instrument arrangements, and one of the loops from the produced set of musical elements.

The selected musical elements represent the song model or outline. Audio data is generated based on the selected musical elements and rendered to the user. In such an embodiment, the determined high-level musical attributes such as style, tempo, intensity, complexity, and chord progressions are used to modify the computer-generated musical output of virtual instruments.

For example, in a real-time, live musical performance environment, the supporting musical tracks in the live performance may be dynamically adjusted in real-time as the performance occurs. The dynamic adjustment may occur continuously or at user-configurable intervals (e.g., every few seconds, every minute, after every played note, after every beat, after every end-note, after a predetermined quantity of notes have been played, etc.). Further, holding a note longer during the performance affects the backing track being played. In one example, a current note being played in the performance and the backing track currently being rendered serve as input to an embodiment of the invention to adjust the backing track. As such, the user may specify transitions (e.g., how the backing track responds to the live musical performance). For example, the user may specify smooth transitions (e.g., select musical elements similar to those currently being rendered) or jarring transitions (select musical elements less similar to those currently being rendered).

The notes, which are played by the user, give a strong indication of active chords, and the sequence of chords provides the chord progression. Embodiments of the invention dynamically adjust the chord progressions on the backing tracks responsive to the input notes. Additionally, the sequences of melody-based or riff-based notes indicate a performance loop. From this information, embodiments of the invention determine pre-defined performance loops that sound musically similar (e.g., in pitch, rhythm, intervals and position on circle of fifths) to the loop being played. With the information on chord progressions and similarity to pre-defined performance loops, the information on the chord progressions and performance loops played by the user allows embodiments of the invention to estimate the high-level parameters (e.g. genre, complexity, etc) associated with the music the user is playing. The parameters are determined via the mapping between the high-level musical concepts and the low-level musical elements described herein. The estimated parameters are used to adapt the virtual instruments accordingly by changing not only the chord progressions but also the entire style of playing to suit the user's live performance. As a result, the user has the ability to dynamically influence the performance of virtual instruments via the user's own performance without having to adjust any parameters directly on the computer (e.g., via the user interface).

Figure 6:
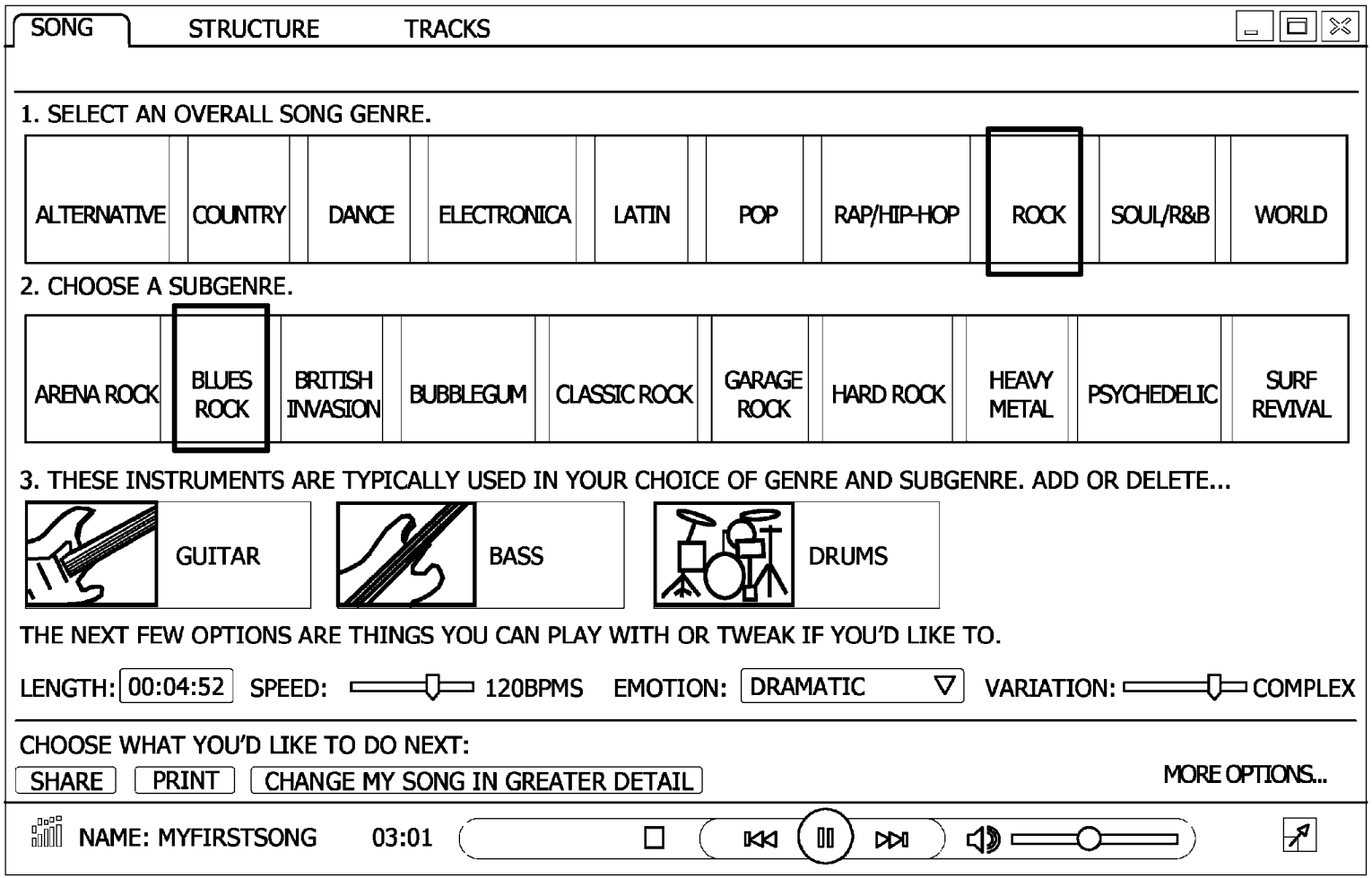
FIG. 6 is an exemplary embodiment of a user interface for aspects of the invention.
Figure 7:
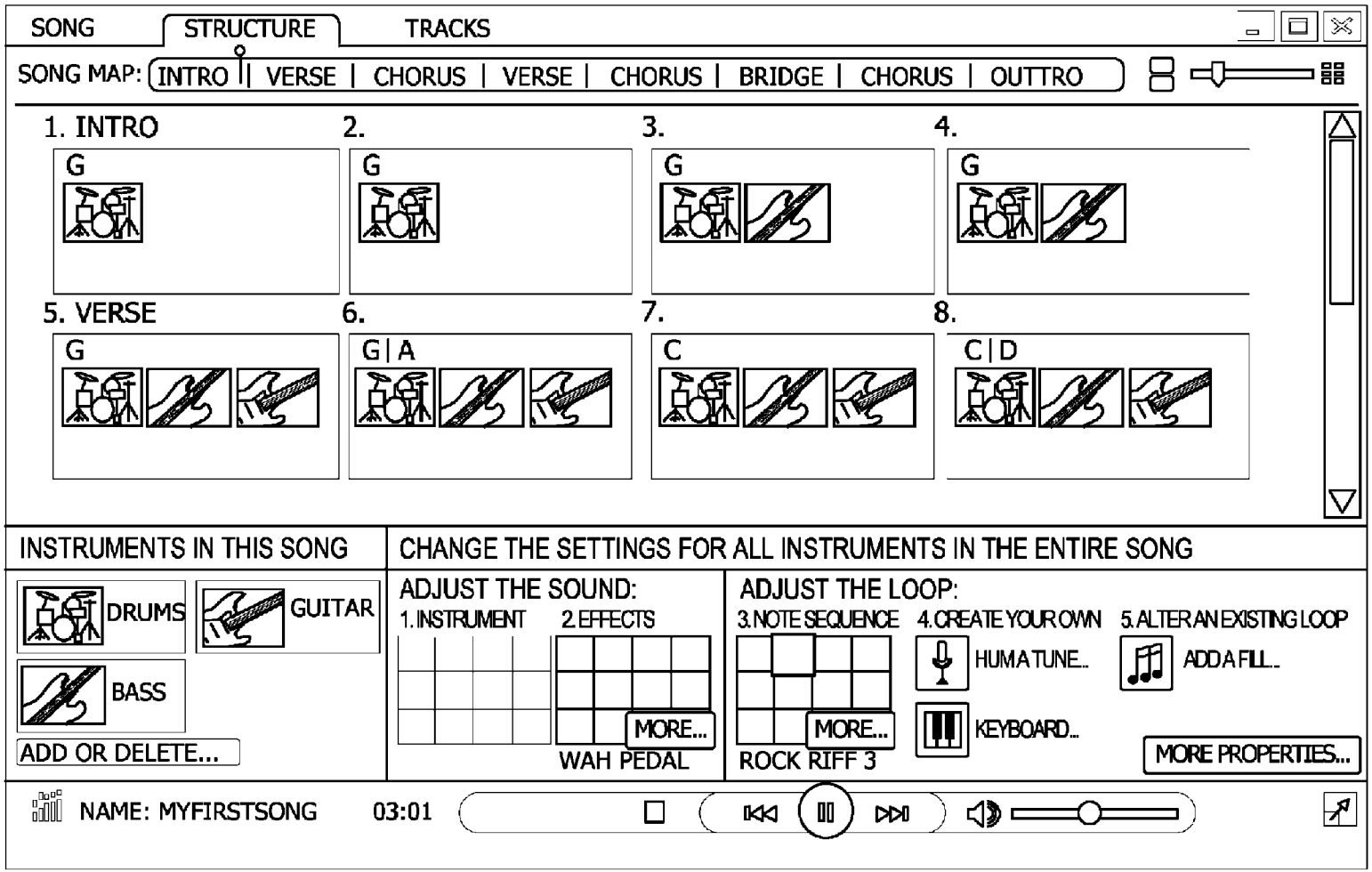
FIG. 7 is another exemplary embodiment of a user interface for aspects of the invention.

FIG. 6 and FIG. 7 illustrate exemplary screen shots of a user interface operable in embodiments of the invention. FIG. 6 illustrates a user interface for the user to specify the high-level metadata describing the song model, backing track, or the like to be created. FIG. 7 illustrates a user interface for the user to select and modify the musical elements selected by an embodiment of the invention that correspond to the input metadata. Once the basic song model has been constructed, the user may change the selections by selecting alternative options presented in an embodiment of the invention as shown in FIG. 7. The user may make these changes at a high level (e.g., affecting the entire song), a lower level (e.g., changing a particular loop in a particular section for a particular instrument), or any intermediate level (e.g., changes for a particular song section or a particular instrument across all song sections).

While aspects of the invention have been described in relation to musical concepts, the embodiments of the invention may generally be applied to any concepts that rely on a library of content at the lower level that has been tagged with higher-level attributes describing the content. For example, the techniques may be applied to lyrics generation for songs. Songs in specific genres tend to use particular words and phrases more frequently than others. A system applying techniques described herein may learn the lyrical vocabulary of a song genre and then suggest words and phrases to assist with lyric writing in a particular genre. Alternately or in addition, a genre may be suggested given a set of lyrics as input data.

The figures, description, and examples herein as well as elements not specifically described herein but within the scope of aspects of the invention constitute means for defining the correlations between the plurality of musical elements each having a musical element value associated therewith and the one or more description categories each having a description value associated therewith, and means for identifying the musical elements and associated musical element values based on the selected description category and associated description value.

The order of execution or performance of the operations in embodiments of the invention illustrated and described herein is not essential, unless otherwise specified. That is, the operations may be performed in any order, unless otherwise specified, and embodiments of the invention may include additional or fewer operations than those disclosed herein. For example, it is contemplated that executing or performing a particular operation before, contemporaneously with, or after another operation is within the scope of aspects of the invention.

Embodiments of the invention may be implemented with computer-executable instructions. The computer-executable instructions may be organized into one or more computer-executable components or modules. Generally, program modules include, but are not limited to, routines, programs, objects, components, and data structures that perform particular tasks or implement particular abstract data types. Aspects of the invention may be implemented with any number and organization of such components or modules. For example, aspects of the invention are not limited to the specific computer-executable instructions or the specific components or modules illustrated in the figures and described herein. Other embodiments of the invention may include different computer-executable instructions or components having more or less functionality than illustrated and described herein.

When introducing elements of aspects of the invention or the embodiments thereof, the articles "a," "an," "the," and "said" are intended to mean that there are one or more of the elements. The terms "comprising," "including," and "having" are intended to be inclusive and mean that there may be additional elements other than the listed elements.

Having described aspects of the invention in detail, it will be apparent that modifications and variations are possible without departing from the scope of aspects of the invention as defined in the appended claims. As various changes could be made in the above constructions, products, and methods without departing from the scope of aspects of the invention, it is intended that all matter contained in the above description and shown in the accompanying drawings shall be interpreted as illustrative and not in a limiting sense.

What is claimed is:

1. A computer-implemented method of modeling musical compositions, said method comprising:

defining a plurality of low level musical elements of the musical composition, said low level musical elements corresponding to identified patterns in the musical composition;

defining musical element values, each specifying a value of one of the plurality of defined low level musical elements associated therewith;

associating metadata with each of the plurality of low level musical elements of each musical composition and with the associated musical element values, said metadata describing the low level musical element and the low level musical element value associated with said metadata;

generating a numerical weight corresponding to each of the defined musical element values based on a number of users who have tagged the musical element value with the metadata associated therewith;

storing each of the defined plurality musical values in a database, said database relating said each defined musical value to the metadata associated therewith and the numerical weight corresponding thereto;

determining a selection of the metadata;

querying the database based on the determined selection of metadata and the corresponding numerical weights to produce a set of low level musical elements and associated musical element values that have numerical weights indicative of a positive correspondence between said musical element values and the determined selection of metadata;

ordering the produced set of low level musical elements and associated musical element values based on the numerical weights corresponding thereto; and providing the ordered, produced set of low level musical elements and associated musical element values to a user.

2. The method of claim 1, wherein associating the metadata comprises defining one or more description categories and description values associated therewith each of the plurality of low level musical elements and associated musical element values, and wherein determining the selection of the metadata comprises receiving, from the user, a selection of at least one of the description categories and at least one of the description values associated with the selected description category.

3. The method of claim 1, further comprising:

selecting, from the set of low level musical elements and associated musical element values, at least one of the musical element values corresponding to each type of low level musical element to create a song model; and generating audio data based on the selected musical element values.

4. The method of claim 3, wherein selecting the at least one of the musical element values comprises selecting per instrument per song section one or more of the following: a particular song structure, a particular instrument arrangement, and a particular loop.

5. The method of claim 1, wherein the low level musical elements comprise at least one of the following: a song structure, a song section, an instrument, and an instrument arrangement.

6. The method of claim 1, wherein the low level musical elements comprise at least one of the following: a chord, a chord progression, a loop, and a note.

7. The method of claim 1, wherein the metadata includes a description category and a description value associated with said description category, said description category being one or more of the following: genre, period, style, mood, and complexity.

8. The method of claim 1, wherein one or more computer-readable media have computer-executable instructions for performing the method recited in claim 1.

9. A system for modeling musical compositions, said system comprising:

a memory area for storing a database relating each of a plurality of musical element values with metadata describing the musical element value, each of said plurality of musical element values specifies a value of a low level musical element of a musical composition; and a processor configured to execute computer-executable instructions for:

receiving input from a one or more users of a community of users indicating a correspondence between metadata and one or more of the plurality of musical element values;

tagging the one or more of the plurality of musical element values with the corresponding metadata as indicated by the received input;

generating a numerical weight for each musical element value of said plurality based on the number of users who have tagged the musical element value with particular metadata and associating the generated numerical weight with the musical element value in the database;

receiving, from a user, a selection of the metadata;

querying the database based on the selected metadata and the assigned numerical weights to determine a highest-scoring musical element value, said highest-scoring musical element value having the strongest correspondence to the selected metadata of the plurality of musical element values in the database as indicated by the numerical weight associated therewith;

selecting the highest-scoring musical element value to create a song model.

10. The system of claim 9 wherein the processor is further configured to execute computer-executable instructions for generating audio data representative of the highest-scoring musical element value.

11. The system of claim 9 wherein when said querying the database results in a determination of a plurality of highest-scoring musical element values, said selecting comprises randomly selected a highest-scoring musical element value from said plurality of highest-scoring musical element values.

12. The system of claim 9 wherein the musical element values specify values for one or more of the following low level musical elements: a song structure, a song section, an instrument, and an instrument arrangement.

13. The system of claim 9 wherein the musical element values specify values for one or more of the following low level musical elements: a chord, a chord progression, a loop, and a note.

14. The system of claim 9, wherein the metadata includes a description category and a description value associated with said description category, said description category being one or more of the following: genre, period, style, mood, and complexity.

15. A system for modeling musical compositions, said system comprising:

a memory area for storing a database having a plurality of low level musical elements of the musical compositions, said low level musical elements corresponding to identified patterns in the musical composition, each of said low level musical elements having a musical element value associated therewith and one or more description categories each having a description value associated therewith, said musical element value specifying a value of the low level musical element associated therewith; and a processor configured to execute computer-executable instructions for:

generating a numerical weight for each of the musical element values and assigning the generated numerical weight thereto, wherein said numerical weight corresponds to a number of users who have tagged the musical element value with the description value associated therewith;

adding the assigned numerical weights to the database so that each musical element value is related to the description value associated therewith via the assigned numerical weight;

receiving, from a user, a selection of at least one of the description categories and associated description value;

querying the database based on the selected description category and associated description value and the assigned numerical weights to produce a set of low level musical elements and associated musical element values that have assigned numerical weights indicating a positive number of users have tagged the musical element values with the selected description value;

ordering the produced set of low level musical elements and associated musical element values based on the assigned numerical weights according to the number of users who have tagged the musical element values with the selected description value; and selecting, from the ordered, produced set, at least one of the musical element values corresponding to each type of identified low level musical element to create a song model.

16. The system of claim 15, wherein the description categories comprise one or more of the following: genre, period, style, mood, and complexity.

17. The system of claim 15, further comprising:

means for defining the correlations between the plurality of low level musical elements each having a musical element value associated therewith and the one or more description categories each having a description value associated therewith; and means for identifying the low level musical elements and associated musical element values based on the selected description category and associated description value.

18. The system of claim 15, wherein the low level musical elements comprise at least one of the following: a song structure, a song section, an instrument, and an instrument arrangement.

19. The system of claim 15, wherein the low level musical elements comprise at least one of the following: a chord, a chord progression, a loop, and a note.

20. The system of claim 15, further comprising one or more computer-readable media having computer-executable components comprising:

a correlation module for defining the plurality of low level musical elements and associated musical element values and the description categories and associated description values;

an interface module for receiving, from a user, a selection of at least one of the description categories and at least one of the description values associated with the selected description category;

a database module for querying the plurality of low level musical elements and associated musical element values defined by the correlation module based on the description category and the description value selected by the user via the interface module and the assigned numerical weights to produce a set of low level musical elements and associated musical element values that have assigned numerical weights indicating a positive number of users have tagged the musical element values with the selected description value; and a backing track module for selecting, from the set of low level musical elements and associated musical element values from the database module, at least one of the musical element values corresponding to each type of low level musical element to create a song model.

* * * * *

UNITED STATES PATENT AND TRADEMARK OFFICE

CERTIFICATE OF CORRECTION

PATENT NO. : 7,858,867 B2
APPLICATION NO. : 12/844363
DATED : December 28, 2010
INVENTOR(S) : Adil Ahmed Sherwani et al.

It is certified that error appears in the above-identified patent and that said Letters Patent is hereby corrected as shown below:

In column 11, line 59, in Claim 2, after "therewith" insert -- with --.

Signed and Sealed this
Fourteenth Day of February, 2012

David J. Kappos

David J. Kappos
*Director of the United States Patent and Trademark Office*